US010522130B2

(12) United States Patent
Kumar et al.

(10) Patent No.: US 10,522,130 B2
(45) **Date of Patent: *Dec. 31, 2019**

(54) ACTIVE NOISE CANCELATION WITH CONTROLLABLE LEVELS

(71) Applicant: Avnera Corporation, Beaverton, OR (US)

(72) Inventors: Amit Kumar, Portland, OR (US); Eric Sorensen, Portland, OR (US)

(73) Assignee: AVNERA CORPORATION, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/103,863

(22) Filed: Aug. 14, 2018

(65) Prior Publication Data

US 2018/0350340 A1 Dec. 6, 2018

Related U.S. Application Data

(63) Continuation of application No. 15/570,273, filed as application No. PCT/US2016/057226 on Oct. 14, 2016, now Pat. No. 10,049,653, which is a continuation of application No. 14/885,639, filed on Oct. 16, 2015, now abandoned.

(51) Int. Cl.
*G10K 11/178* (2006.01)

(52) U.S. Cl.
CPC .... *G10K 11/178* (2013.01); *G10K 2210/1081* (2013.01); *G10K 2210/3014* (2013.01); *G10K 2210/3026* (2013.01); *G10K 2210/3027* (2013.01); *G10K 2210/3028* (2013.01)

(58) Field of Classification Search
CPC ..... G10K 11/178; G10K 2210/1081; G10K 2210/3014; G10K 2210/3026; G10K 2210/3027; G10K 2210/3028
See application file for complete search history.

(56) References Cited

U.S. PATENT DOCUMENTS

| | | | |
|---|---|---|---|
| 4,947,440 | A | 8/1990 | Bateman et al. |
| 6,160,893 | A | 12/2000 | Saunders et al. |
| 2005/0063552 | A1 | 3/2005 | Shuttleworth et al. |
| 2010/0310086 | A1 | 12/2010 | Magrath et al. |
| 2011/0243344 | A1 | 10/2011 | Bakalos et al. |
| 2012/0140917 | A1 | 6/2012 | Nicholson et al. |
| 2012/0316872 | A1 | 12/2012 | Stoltz et al. |
| 2014/0079236 | A1 | 3/2014 | Yamkovoy |
| 2014/0126734 | A1 | 5/2014 | Gauger et al. |

(Continued)

OTHER PUBLICATIONS

International Search Report and Written Opinion from International Application No. PCT/US2016/057226, dated Jan. 23, 2017, 10 pages.

(Continued)

*Primary Examiner* — Mark Fischer
(74) *Attorney, Agent, or Firm* — Miller Nash Graham & Dunn LLP

(57) ABSTRACT

A system including an automatic noise canceling (ANC) headphone and a processor. The ANC headphone has a microphone configured to generate a microphone signal and at least two non-zero ANC gain levels. The processor is configured to receive the microphone signal, determine a characteristic of the microphone signal, and identify a revised ANC level from the ANC gain levels based on a comparison of the characteristic to at least one threshold. Methods are also disclosed.

20 Claims, 3 Drawing Sheets

(56) References Cited

U.S. PATENT DOCUMENTS

| | | | |
|---|---|---|---|
| 2014/0270223 | A1 | 9/2014 | Li et al. |
| 2015/0071453 | A1 | 3/2015 | Po et al. |
| 2015/0195646 | A1 | 7/2015 | Kumar et al. |
| 2015/0296297 | A1 | 10/2015 | Hua et al. |
| 2015/0332662 | A1 | 11/2015 | Hoang Co Thuy et al. |
| 2016/0260445 | A1 | 9/2016 | Duwenhorst |
| 2016/0300562 | A1 | 10/2016 | Goldstein |

OTHER PUBLICATIONS

Wikipedia, https://web.archive.org/web/20150608023639/https://en.wikipedia.org/wiki/Sound_power, published Jun. 2015.

Bruce Fries et al., Digital Audio Essentials, Apr. 2005, O'Reilly Media, First Edition, p. 234.

ACTIVE NOISE CANCELATION WITH CONTROLLABLE LEVELS

CROSS-REFERENCE TO RELATED APPLICATIONS

This application is a continuation of and claims benefit from co-pending U.S. non-provisional patent application Ser. No. 15/570,273, filed Oct. 27, 2017, entitled ACTIVE NOISE CANCELLATION WITH CONTROLLABLE LEVELS, which is a national stage filing under 35 U.S.C. § 371 of International Application No. PCT/US2016/057226, filed Oct. 14, 2016, entitled ACTIVE NOISE CANCELLATION WITH CONTROLLABLE LEVELS, and claims priority from U.S. patent application Ser. No. 14/885,639, filed Oct. 16, 2015, entitled ACTIVE NOISE CANCELLATION WITH CONTROLLABLE LEVELS, the disclosures of all of which are incorporated herein by reference in their entirety.

FIELD OF THE INVENTION

This disclosure is related to audio processing and, more particularly, to a system and method for adjusting the noise cancellation level of an automatic noise cancellation system.

BACKGROUND

Active noise cancellation (ANC) is a conventional method of reducing an amount of undesired noise received by a user listening to audio through headphones. The noise reduction is typically achieved by playing an anti-noise signal through the headphone's speakers. The anti-noise signal is an approximation of the negative of the undesired noise signal that would be in the ear cavity in the absence of ANC. The undesired noise signal is then neutralized when combined with the anti-noise signal.

In a general noise-cancellation process, one or more microphones monitor ambient noise or residual noise in the ear cups of headphones in real-time, then the speaker plays the anti-noise signal generated from the ambient or residual noise. The anti-noise signal may be generated differently depending on factors such as physical shape and size of the headphone, frequency response of the speaker and microphone transducers, latency of the speaker transducer at various frequencies, sensitivity of the microphones, and placement of the speaker and microphone transducers, for example.

In feedforward ANC, the microphone senses ambient noise but does not appreciably sense audio played by the speaker. In other words, the feedforward microphone does not monitor the signal directly from the speaker. In feedback ANC, the microphone is placed in a position to sense the total audio signal present in the ear cavity. So, the microphone senses the sum of both the ambient noise as well as the audio played back by the speaker. A combined feedforward and feedback ANC system uses both feedforward and feedback microphones.

Along with reducing the ambient noise heard by a user, however, ANC systems also add a small amount of noise. This added noise may be noticeable to the user as a hiss when the user is in a quiet environment.

For example, FIG. 1 is a plot showing noise floor levels for three conditions of an example headphone having a conventional ANC system operated in a quiet room. A first trace 101 represents the noise floor over various frequencies when the headphone and the conventional ANC system are both powered off, which is the ambient noise level of the environment. A second trace 102 represents the noise floor when the headphone is powered on and the conventional ANC system is powered off. And a third trace 103 represents the noise floor when the headphone and the conventional ANC system are both powered on. Frequency is indicated on the horizontal axis, while the vertical axis indicates power spectral density.

As illustrated in FIG. 1, there may be a range of frequencies in which the noise floor with the headphone and conventional ANC system both powered on, shown in the third trace 103, exceeds the noise floor with the headphone and conventional ANC system both powered off, shown in the first trace 101. As noted, the user may perceive this as ANC hiss, particularly in a quiet environment.

Even when there is no ANC hiss, some users find strong ANC to be unpleasant.

Embodiments of the invention address these and other issues in the prior art.

SUMMARY OF THE DISCLOSURE

Embodiments of the disclosed subject matter reduce the ANC hiss perceived by a user by reducing the ANC gain, particularly the feedback ANC gain, when the ambient noise level is less than the ANC hiss level. Embodiments may also provide a more pleasant listening experience by providing a lower ANC gain regardless of ANC hiss.

Accordingly, at least some embodiments of a system may include an automatic noise canceling (ANC) headphone and a processor. The ANC headphone may have a microphone configured to generate a microphone signal and at least two non-zero ANC gain levels. The processor may be configured to receive the microphone signal, determine a characteristic of the microphone signal, identify a revised ANC level from the ANC gain levels based on a comparison of the characteristic to at least one threshold, and output a signal corresponding to the revised ANC level.

In another aspect, at least some embodiments of a method of reducing ANC hiss in a headphone having an ANC system may include: determining whether a noise floor of an ANC noise level exceeds an ambient noise level for a frequency range, and, if so, reducing a feedback ANC gain of the ANC system for the frequency range until the ANC noise level is less than the ambient noise level for the frequency range.

In yet another aspect, at least some embodiments of a method of revising an ANC gain level in an ANC headphone by a processor linked to the ANC headphone may include: receiving a microphone signal from a microphone of an ANC headphone having at least two non-zero ANC gain levels; determining a characteristic of the microphone signal; identifying a revised ANC level from the ANC gain levels based on a comparison of the characteristic to at least one threshold; and outputting a signal corresponding to the revised ANC level.

DETAILED DESCRIPTION

In general, systems and methods according to embodiments of the invention reduce the ANC hiss perceived by a user by reducing the ANC gain, particularly the feedback ANC gain, when the ambient noise level is less than the ANC hiss level. As noted above, conventional ANC systems add a small amount of noise, or ANC hiss, to a headphone signal. To reduce ANC hiss, embodiments of the invention include multiple ANC "on" states, which have different amounts, or levels, of ANC gain. A smaller gain generally provides softer ANC and less ANC hiss, particularly in mid-range frequencies of between about 350 Hz and about 2500 Hz. A higher gain generally provides more active noise cancellation, particularly in low frequencies less than about 350 Hz. Regardless of ANC hiss, some users find a lower level of ANC gain to be more pleasant.

Figure 2:
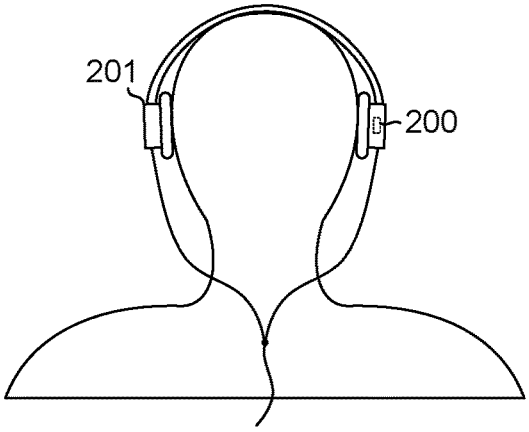
FIG. 2 shows a controllable-level ANC system, according to embodiments, which is integrated into a headphone as an example implementation.

FIG. 2 shows a controllable-level ANC system 200 integrated into a headphone 201 as an example implementation. The term "headphone" as used in this disclosure includes earbuds, in-ear monitors, and pad- or cup-style headphones that are used in just one ear or in both ears. The controllable-level ANC system 200 may be present for the left ear, the right ear, or both ears.

Figure 3:
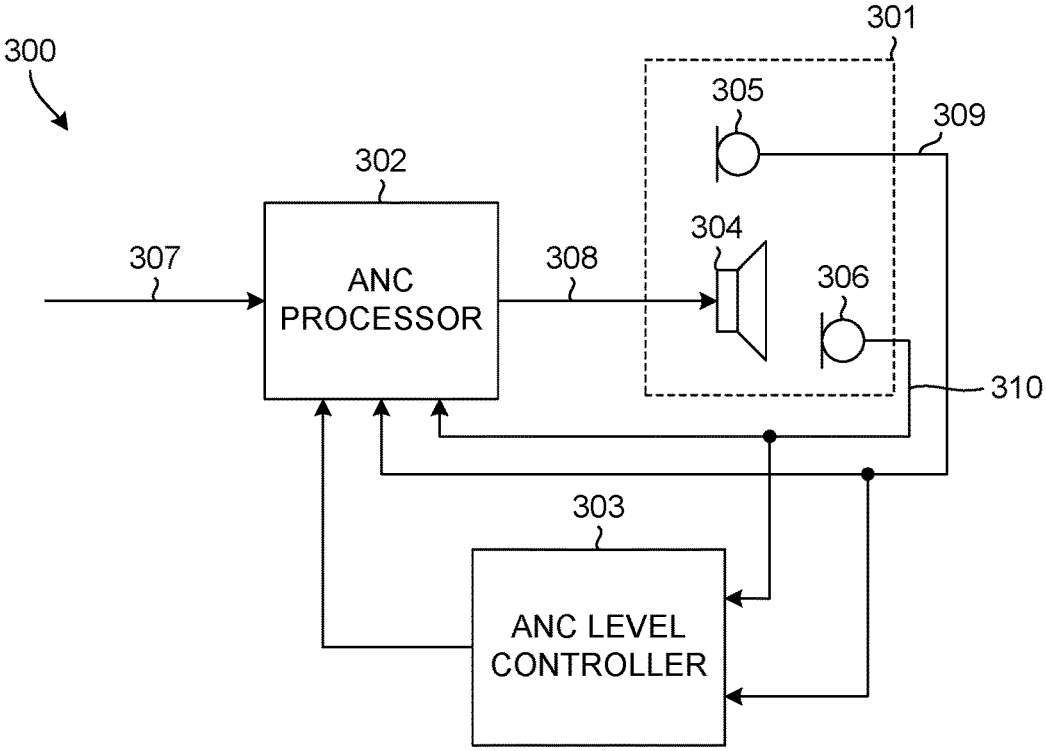
FIG. 3 is a functional block diagram showing components of a controllable-level ANC system, according to embodiments.

FIG. 3 is a functional block diagram showing components of an embodiment of a controllable-level ANC system 300, which may be an embodiment of the controllable-level ANC system 200 of FIG. 2. As illustrated in FIG. 3, a controllable-level ANC system 300 may include an ANC processor 302; an ANC level controller 303; and a headphone 301 having a speaker 304, a feedforward microphone 305, and a feedback microphone 306.

Embodiments of the controllable-level ANC system 300 may be implemented as one or more components integrated into the headphone 301, one or more components connected to the headphone 301, or software operating in conjunction with an existing component or components. For example, the ANC processor 302 or software driving the ANC processor, or both, might be modified to implement embodiments of the controllable-level ANC system 300.

The ANC processor 302 receives a headphone audio signal 307 and sends an ANC-compensated audio signal 308 to the headphone 301. The feedforward microphone 305 generates a feedforward microphone signal 309, which is received by the ANC processor 302 and the ANC level controller 303. The feedback microphone 306 likewise generates a feedback microphone signal 310, which is received by the ANC processor 302 and the ANC level controller 303.

The headphone audio signal 307 is a signal characteristic of the desired audio to be played through the headphone's speaker 304 as an audio playback signal. Typically, the headphone audio signal 307 is generated by an audio source such as a media player, a computer, a radio, a mobile phone, a CD player, or a game console during audio play. For example, if a user has the headphone 301 connected to a portable media player playing a song selected by the user, then the headphone audio signal 307 is characteristic of the song being played.

Typically, the feedforward microphone 305 samples an ambient noise level and the feedback microphone 306 samples the output of the speaker 304 and a portion of the ambient noise at the speaker 304. The sampled portion includes a portion of ambient noise that is not attenuated by the body and physical enclosure of the headphone 301. In general, these microphone samples are fed back to the ANC processor 302, which produces anti-noise signals from the microphone samples and combines them with the headphone audio signal 307 to provide the ANC-compensated audio signal 308 to the headphone 301. The ANC-compensated audio signal 308, in turn, allows the speaker 304 to produce a noise-reduced audio output.

Preferably, the ANC processor 302 is configured to have at least two non-zero ANC gain levels. For example, the ANC gain levels may include a soft-gain level and a strong-gain level that is greater than the soft-gain level. As another example, the ANC gain levels may include a soft-gain level, a mid-gain level that is greater than the soft-gain level, and a strong-gain level that is greater than the mid-gain level. As noted above, a lower gain level generally provides softer ANC, while a higher gain level generally provides more active noise cancellation. Thus, for example, the strong-gain level may be useful in noisy environments, while the soft-gain level may be useful in very quiet environments. The mid-gain level may be useful in environments that are between very quiet and noisy, such as a room that is quiet except for some low-frequency noise.

The ANC gain levels may include feedback ANC gain levels, which may be a gain level of the feedback anti-noise signal, or feedforward ANC gain levels, which may be a gain level of the feedforward anti-noise signal, or both. Preferably, though, the ANC gain levels are the gain level of the feedback anti-noise signal.

Although shown separately in FIG. 3, the ANC level controller 303 may be integrated with the ANC processor 302. For example, the ANC processor 302 or software driving the ANC processor, or both, might be modified to implement the ANC level controller 303. Otherwise, the ANC level controller 303 may be a separate processor.

In general, the ANC level controller 303 may be configured to receive a microphone signal, such as the feedforward microphone signal 309 or the feedback microphone signal 310, or both, and determine a characteristic of the microphone signal. For example, the ANC level controller 303 may determine a power value of a low-frequency range of the microphone signal and a power value of a mid-frequency range of the microphone signal. The low-frequency range has a median frequency that is less than a median frequency of the mid-frequency range. Thus, for example, the low-frequency range may be about 20 Hz to 600 Hz and the mid-frequency range may be about 500 Hz to about 2500 Hz. The median, or middle, frequency of the low-frequency range of around 300 Hz is less than the median frequency of the mid-frequency range of around 1500 Hz. Although these two example ranges overlap, an overlap is not required by all embodiments.

The ANC level controller 303 may also identify a revised ANC level, which may differ from the current or initial ANC level, based on a comparison of the characteristic to a threshold. For example, the current or initial ANC level may be the strong-gain level, and the ANC level controller 303 may identify the soft-gain level as the revised ANC level after comparing the characteristic to the threshold.

Figure 4:
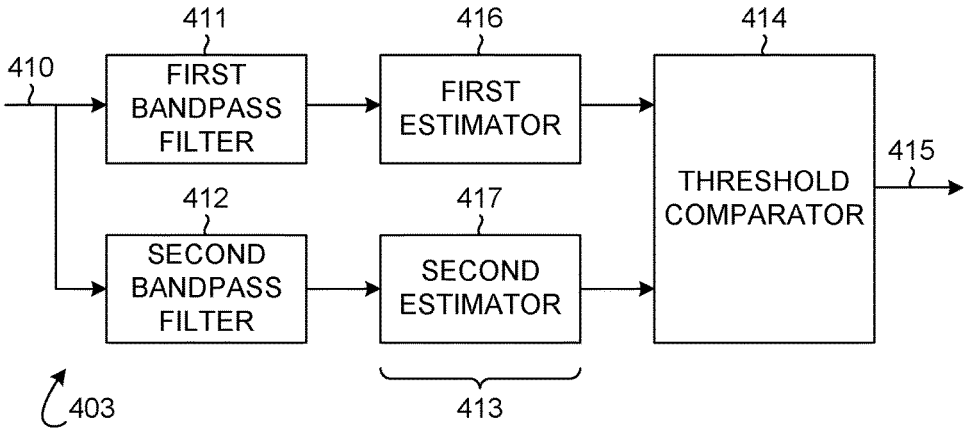
FIG. 4 is a functional block diagram showing example components of an ANC level controller, according to embodiments.

The ANC level controller 303 may output a signal, such as the output signal 415 of FIG. 4, corresponding to the revised ANC level. The output signal of the ANC level controller 303 may include a request to increase or decrease the current or initial ANC gain level to another ANC gain level, such as the soft-gain level, the mid-gain level, or the strong-gain level, or the output signal may include a request to set the ANC gain level to zero or off. Thus, the output signal of the ANC level controller 303 may correspond to a next sequential gain level in either the increasing gain or decreasing gain direction. For example, if the initial ANC gain level is zero or off, then the output signal of the ANC level controller 303 may correspond to the next sequential gain level, such as the soft-gain level. Alternatively, the output signal of the ANC level controller 303 may include a request for a particular ANC gain level. Thus, the output signal of the ANC level controller 303 might not correspond to the next sequential gain level. For example, if the initial ANC gain level is zero or off, then the output signal of the ANC level controller 303 may correspond to a gain level that is two or more levels away, such as by skipping the soft-gain level and instead indicating the mid-gain level or the strong-gain level. In the other direction, an initial ANC gain level that is, for example, the strong-gain level may be reduced sequentially to, for example, the mid-gain level or non-sequentially to, for example, the soft-gain level.

The spacing between the gain levels may be, for example, about five decibels, although other spacing could be used. Moreover, the spacing between the soft-gain level and the mid-gain level may differ from the spacing between the mid-gain level and the strong-gain level. Or it could be the same.

In some embodiments, the ANC level controller 303 is configured to detect whether audio is being played by the audio speaker 304 and, when audio is being played, to output a signal corresponding to the strong-gain level. That is, the user may be less likely to detect ANC hiss, even at the strong-gain level, if audio is being played by the speaker 304. As an example, the ANC level controller 303 may detect whether audio is being played by analyzing the feedback microphone signal 310.

In some embodiments, the ANC level controller 303 or the ANC processor 302, or both, may be configured to match the ANC level to a predetermined audio equalizer (EQ) profile. For example, each ANC gain level may have a corresponding audio EQ profile. Thus, when the ANC level controller 303 identifies the revised ANC gain level, the ANC processor 302 may also engage audio EQ filters that correspond to the audio EQ profile. In this way, when the ANC gain level, or softness, changes, the audio EQ profile also changes. This may reduce or eliminate any apparent change in audio tone at the speaker 304. In some embodiments, the audio EQ filters are cross-feathered at the same rate as the anti-noise signal to which the ANC gain level has been applied. The output signal of the ANC level controller 303 may include matching information that identifies or corresponds to the audio EQ profile that is matched to the ANC gain level so that, for example, the ANC processor 302 may engage the appropriate audio EQ filters.

FIG. 4 is a functional block diagram showing example components of an embodiment of an ANC level controller 403, which may be an embodiment of the ANC level controller 303 of FIG. 3. As illustrated in FIG. 4, an ANC level controller 403 may include a first bandpass filter 411, a second bandpass filter 412, an estimator 413, and a threshold comparator 414. A microphone signal 410 is split and passes through the first bandpass filter 411 and the second bandpass filter 412. In systems having left and right channels of the microphone signal 410, the left and right channels may be combined and the stronger of the two channels may be selected for filtering. The filtered microphone signal 410 may then pass to the estimator 413 and then to the threshold comparator 414, which may output a signal 415 corresponding to a revised or suggested ANC gain level. Preferably, the microphone signal 410 is a feedback microphone signal.

The first bandpass filter 411 may have a center frequency that is lower than the center frequency of the second bandpass filter 412. Thus, the first bandpass filter 411 may be configured to filter a low-frequency range of the microphone signal 410, and the second bandpass filter 412 may be configured to filter a mid-frequency range of the microphone signal 410. For example, the first bandpass filter 411 may have a passband of about 20 Hz to about 600 Hz, and the second bandpass filter 412 may have a passband of about 500 Hz to about 2500 Hz. In some embodiments, the first bandpass filter 411 or the second bandpass filter 412, or both, may have programmable coefficients.

The estimator 413 is configured to estimate or determine a feature or characteristic of the microphone signal 410. For example, the estimator 413 may determine a power value of the low-frequency range of the microphone signal 410 and a power value of the mid-frequency range of the microphone signal 410. The estimator 413 may include a first estimator 416 for the low-frequency range of the microphone signal 410 and a second estimator 417 for the mid-frequency range of the microphone signal 410. In some embodiments, the estimator 413 may be a moving-window mean-square estimator, and the moving-window mean-square estimator may have a programmable time constant.

The threshold comparator 414 is configured to compare the output of the estimator 413 with one or more thresholds. For example, the threshold comparator 414 may compare the power value of the low-frequency range of the microphone signal 410 to a first threshold and the power value of the mid-frequency range of the microphone signal 410 to a second threshold. Preferably, the first threshold is not equal to the second threshold. In general, a relatively higher power value in either the low-frequency range or the mid-frequency range would tend to result in an output signal 415 that corresponds to a higher, or stronger, ANC gain level. Conversely, a relatively lower power value in either the low-frequency range or the mid-frequency range would tend to result in an output signal 415 that corresponds to a softer ANC gain level.

Figure 5:
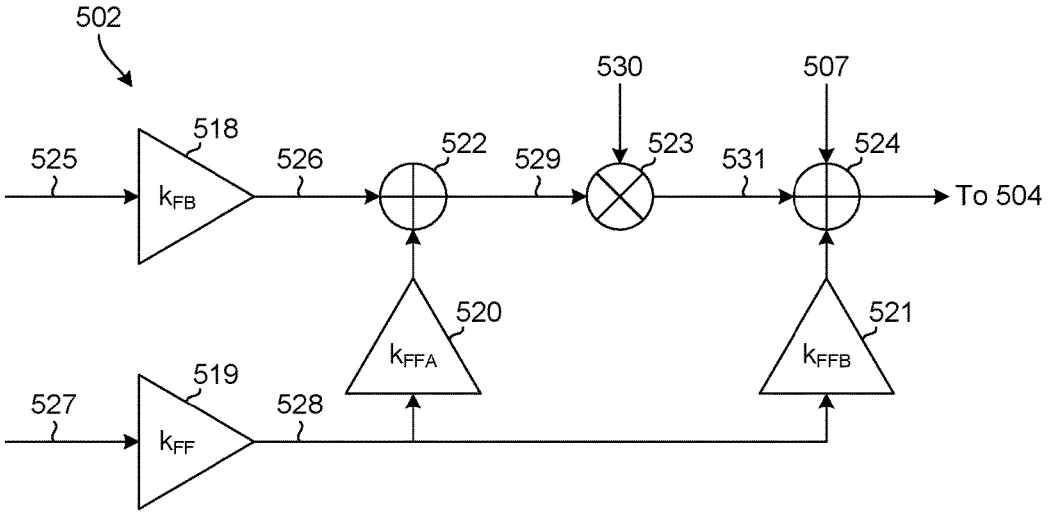
FIG. 5 is functional block diagram showing example components of an ANC processor with signal feathering, according to embodiments.

FIG. 5 is a functional block diagram showing example components of an ANC processor 502, such as the ANC processor 302 of FIG. 3, further configured to feather certain signals. As illustrated in FIG. 5, an ANC processor 502 allowing for feathered signals may include a feedback ANC gain device 518 or circuit, a feedforward ANC gain device 519 or circuit, a first feedforward controllable gain 520 or circuit, and a second feedforward controllable gain 521 or circuit as well as a first mixer 522, a second mixer 523, and a third mixer 524. The feedback ANC gain device 518, which may be a controllable gain device, receives a feedback anti-noise signal 525 from the ANC processor 502, or from another part of the ANC processor 502, and outputs a first signal 526 to the first mixer 522. The feedforward ANC gain device 519, which may be a controllable gain device, receives a feedforward anti-noise signal 527 from the ANC processor 502, or from another part of the ANC processor 502, and outputs a second signal 528 to the first feedforward controllable gain 520 and the second feedforward controllable gain 521. The output of the first mixer 522 passes to an input side 529 of the second mixer 523, or feathered gain mixer, where a feathered gain 530 is introduced and applied. The feathered output leaves an output side 531 of the second mixer 523 passes to the third mixer 524, where it is combined with a headphone audio signal 507, or forward audio signal, and possibly the second signal 528 from the feedforward ANC gain device 519. This is explained in more detail below. The output of the third mixer 524 then passes to a speaker 504, such as the audio speaker 304 of FIG. 3.

Preferably, the first feedforward controllable gain 520 and the second feedforward controllable gain 521 each have a gain of either zero or one. When the gain is zero, the controllable gain does not allow the second signal 528 from the feedforward ANC gain device 519 to pass through the controllable gain. When the gain is one, the controllable gain allows the second signal 528 from the feedforward ANC gain device 519 to pass through the controllable gain without increasing or decreasing the power of the second signal 528. But other gain values also may be used. For example, the gain value might be less than one but greater than zero. As another example, the gain value might be greater than one.

In this way, the feedback anti-noise signal 525 or the feedforward anti-noise signal 527, or both, may be feathered between an off state and an ANC gain level and also between ANC gain levels. For example, when the gain value of the first feedforward controllable gain 520 is zero, the gain value of the second feedforward controllable gain 521 will generally be one. Thus, the feedback anti-noise signal 525 is feathered while the feedforward anti-noise signal 527 is not feathered because the feedforward anti-noise signal 527 does not pass through the feathered gain mixer 523. As another example, when the gain value of the first feedforward controllable gain 520 is one, the gain value of the second feedforward controllable gain 521 will generally be zero. Thus, both the feedback anti-noise signal 525 and the feedforward anti-noise signal 527 are feathered because both pass through the feathered gain mixer 523.

Figure 1:
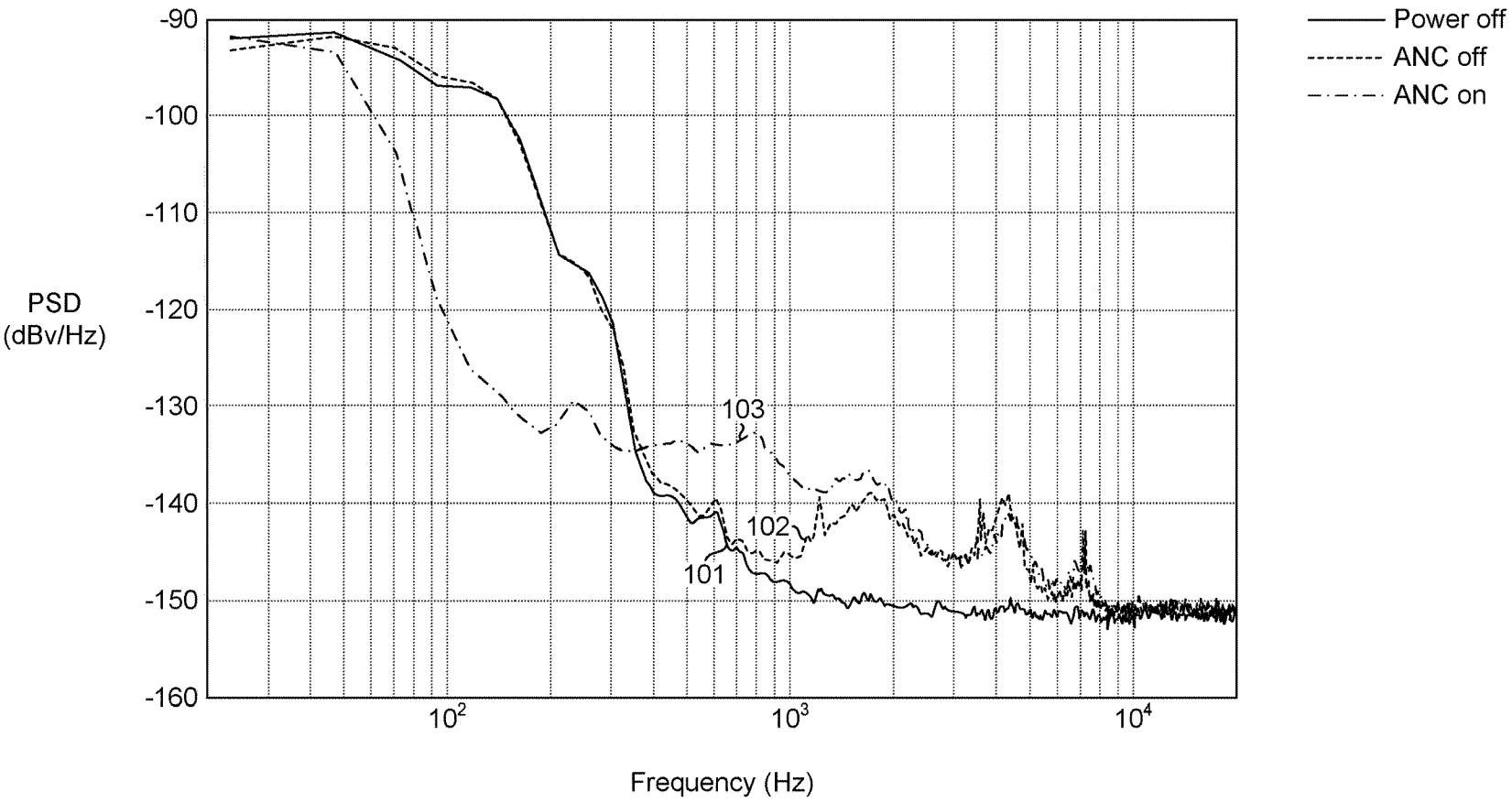
FIG. 1 PRIOR ART
FIG. 1 is a plot showing noise floor levels for three conditions of an example headphone having a conventional ANC system operated in a quiet room.

As explained above for FIG. 1, there may be a range of frequencies in which the noise floor with a headphone and a conventional ANC system both powered on, shown in the third trace 103 of FIG. 1, exceeds the noise floor with the headphone and the conventional ANC system both powered off, shown in the first trace 101 of FIG. 1. A user in a quiet environment may perceive this as ANC hiss. Thus, according to the presently disclosed subject matter, a method of reducing ANC hiss in a headphone having an automatic noise canceling (ANC) system, such as the controllable-level ANC system 200 of FIG. 2 or the controllable-level ANC system 300 of FIG. 3, may include determining whether a noise floor of an ANC noise level exceeds an ambient noise level for a frequency range. If the noise floor of an ANC noise level does exceed the ambient noise level, the method may also include reducing a feedback ANC gain of the ANC system for the frequency range until the ANC noise level is less than the ambient noise level for the frequency range. For example, the feedback ANC gain may be reduced from an initial gain level to one of a plurality of feedback ANC gain levels, such as a mid-gain level and a soft-gain level.

Embodiments of the invention may operate on a particularly created hardware, on firmware, digital signal processors, or on a specially programmed general purpose computer including a processor operating according to programmed instructions. The terms "controller" or "processor" as used herein are intended to include microprocessors, microcomputers, ASICs, and dedicated hardware controllers. One or more aspects of the invention may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular abstract data types when executed by a processor in a computer or other device. The computer executable instructions may be stored on a non-transitory computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the invention, and such data structures are contemplated within the scope of computer executable instructions and computer-usable data described herein.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Although specific embodiments of the invention have been illustrated and described for purposes of illustration, it will be understood that various modifications may be made without departing from the spirit and scope of the invention. Accordingly, the invention should not be limited except as by the appended claims.

What is claimed is:

1. A noise reduction system comprising:

an automatic noise canceling headphone having an automatic noise canceling feedforward microphone configured to generate a feedforward microphone signal, the automatic noise canceling headphone further having automatic noise canceling gain levels including at least two non-zero automatic noise canceling gain levels; and a processor configured to:

receive the feedforward microphone signal, determine a power value of a first frequency range of the feedforward microphone signal, determine a power value of a second frequency range of the feedforward microphone signal, and select one of the at least two non-zero automatic noise canceling gain levels based on the determined power values.

2. The noise reduction system of claim 1 in which determining a power value of a first frequency range comprises performing calculations on a moving window of data.

3. The noise reduction system of claim 1 in which the first frequency range is a low-frequency range and the second frequency range is a mid-frequency range.

4. The noise reduction system of claim 3 in which the processor is configured to select one of the at least two non-zero automatic noise canceling gain levels based on a comparison of the power value of the low-frequency range to a first threshold and the power value of the mid-frequency range to a second threshold that is not equal to the first threshold.

5. The noise reduction system of claim 1 in which the at least two non-zero automatic noise canceling gain levels include a soft-gain level and a strong-gain level that is greater than the soft-gain level.

6. The noise reduction system of claim 5 in which the at least two non-zero automatic noise canceling gain levels includes a mid-gain level that is greater than the soft-gain level and less than the strong-gain level.

7. The noise reduction system of claim 1 in which the processor is further configured to feather an anti-noise signal between an off state and at least one of the automatic noise canceling gain levels and to feather the anti-noise signal between a first level of the automatic noise canceling gain levels and a second level of the automatic noise canceling gain levels.

8. A method of reducing automatic noise canceling hiss in a headphone having an ANC system, the method comprising:

generating a feedforward microphone signal from an automatic noise canceling feedforward microphone;

determining a power value of a first frequency range of the feedforward microphone signal;

determining a power value of a second frequency range of the feedforward microphone signal; and selecting one of at least two non-zero automatic noise canceling gain levels of the headphone based on the determined power values.

9. The method of claim 8 in which the feedforward microphone signal from the feedforward microphone of the ANC headphone includes at least two non-zero feedforward ANC gain levels.

10. The method of claim 8 in which the first frequency range is a low-frequency range and the second frequency range is a mid-frequency range.

11. The method of claim 10 in which the selecting one of the at least two non-zero automatic noise canceling gain levels based on the comparison of the determined power levels includes selecting one of the ANC gain levels based on a comparison of the power value of the low-frequency range to a first threshold and the power value of the mid-frequency range to a second threshold that is not equal to the first threshold.

12. The method of claim 8 in which the at least two non-zero automatic noise canceling gain levels include a soft-gain level, a mid-gain level that is greater than the soft-gain level, and a strong-gain level that is greater than the mid-gain level, the method further comprising:

detecting whether audio is being played by an audio speaker of the ANC headphone, and outputting a signal corresponding to the strong-gain level when audio is being played.

13. The method of claim 8 further comprising:

feathering an anti-noise signal between an off state and at least one of the at least two non-zero automatic noise canceling gain levels; and feathering the anti-noise signal between a first level of the at least two non-zero automatic noise canceling gain levels and a second level of the at least two non-zero automatic noise canceling gain levels.

14. The method of claim 13 further comprising:

selectively permitting a feedforward anti-noise signal to pass from a feedforward anti-noise signal path to a feedback anti-noise signal path at an input side of a feathered gain mixer; and selectively permitting the feedforward anti-noise signal to pass from the feedforward anti-noise signal path to an output side of the feathered gain mixer.

15. The method of claim 8 further comprising matching the selected non-zero automatic noise canceling gain level to a predetermined audio equalizer profile.

16. An automatic noise canceling level controller, comprising:

a first bandpass filter configured to filter a feedforward microphone signal in a first frequency range;

a second bandpass filter configured to filter a feedforward microphone signal in a second frequency range;

a first estimator configured to determine a first power value of the first frequency range;

a second estimator configured to determine a second power value of the second frequency range; and a threshold comparator configured to select one of at least two non-zero automatic noise canceling gain levels of a headphone based on the first power value and the second power value.

17. The controller of claim 16 in which the first estimator is a moving-window mean-square estimator configured to determine a power value of a first frequency range comprises performing calculations on a moving window of data.

18. The controller of claim 17 in which the first estimator includes a programmable time constant.

19. The controller of claim 16 in which the first frequency range is a low-frequency range and the second frequency range is a mid-frequency range.

20. The controller of claim 16 in which the first bandpass filter has a center frequency lower than a center frequency of the second bandpass filter.

* * * * *